US009944510B2

(12) United States Patent
Zumbrum

(10) Patent No.: US 9,944,510 B2
(45) Date of Patent: Apr. 17, 2018

(54) CONDUIT TERMINUS AND RELATED FLUID TRANSPORT SYSTEM AND METHOD

(71) Applicant: ALLPURE TECHNOLOGIES, LLC, New Oxford, PA (US)

(72) Inventor: Michael A Zumbrum, New Oxford, PA (US)

(73) Assignee: Sartorius Stedim North America Inc., Bohemia, NY (US)

( * ) Notice: Subject to any disclaimer, the term of this patent is extended or adjusted under 35 U.S.C. 154(b) by 44 days.

(21) Appl. No.: 14/940,580

(22) Filed: Nov. 13, 2015

(65) Prior Publication Data

US 2017/0137278 A1 May 18, 2017

(51) Int. Cl.

| | |
|---|---|
| ***B67D 7/78*** | (2010.01) |
| ***B67D 7/02*** | (2010.01) |
| ***B65B 39/00*** | (2006.01) |
| ***B65B 3/00*** | (2006.01) |

(52) U.S. Cl.

CPC ..... *B67D 7/0288* (2013.01); *B65B 3/003* (2013.01); *B65B 39/00* (2013.01)

(58) Field of Classification Search

CPC ..... B67D 7/38; B67D 7/0288; B65B 39/00; B65B 3/003

USPC ..... 222/464.1, 464.4, 464.7, 204; 220/707–710; 215/388, 389, 229

See application file for complete search history.

(56) References Cited

U.S. PATENT DOCUMENTS

| | | | | |
|---|---|---|---|---|
| 1,625,699 A | | 4/1927 | Benton | |
| 2,533,697 A | | 11/1948 | Stewart | |
| 2,764,317 A | | 11/1950 | Lisciani | |
| 3,645,413 A | * | 2/1972 | Mitchell | A61J 11/008 215/11.1 |
| 3,897,006 A | * | 7/1975 | Tada | B05B 11/3074 222/321.8 |
| D243,456 S | | 2/1977 | Ryan | |
| 4,286,735 A | | 9/1981 | Sneider | |
| D275,984 S | | 10/1984 | Shaw | |
| D298,849 S | | 12/1988 | Lanoue | |
| D300,246 S | | 3/1989 | Brown | |

(Continued)

FOREIGN PATENT DOCUMENTS

WO WO 2009098194 8/2009

OTHER PUBLICATIONS

Contigo Autospout Gizmo Flip water bottle, publicly available at least as of Nov. 11, 2016. Photos taken Dec. 31, 2016.

(Continued)

*Primary Examiner* — Lien Ngo

(74) *Attorney, Agent, or Firm* — Womble Bond Dickinson (US) LLP

(57) ABSTRACT

A fluid transport system is provided. The fluid transport system may include a vessel closure assembly including one or more conduits, a vessel, and a container. A conduit terminus may be engaged with the conduit and received in the vessel. The conduit terminus may include a body with a head portion and an engagement portion, wherein an aperture extends therethrough. The engagement portion may be configured to engage the conduit. The head portion may taper to a tip defining a first opening to the aperture having a contour that is non-planar.

11 Claims, 6 Drawing Sheets

(56) References Cited

U.S. PATENT DOCUMENTS

| | | | | |
|---|---|---|---|---|
| 4,830,235 | A * | 5/1989 | Miller | B05B 15/005 138/121 |
| 4,994,076 | A * | 2/1991 | Guss | A61J 9/00 215/11.1 |
| 5,154,317 | A | 10/1992 | Roppolo | |
| 5,195,664 | A * | 3/1993 | Rhea | B05B 11/0059 222/382 |
| 5,350,080 | A | 9/1994 | Brown et al. | |
| 5,743,442 | A | 4/1998 | Barbe | |
| D408,079 | S | 4/1999 | Ellis | |
| 6,234,412 | B1 * | 5/2001 | von Schuckmann | B05B 1/3436 222/321.8 |
| 6,302,304 | B1 * | 10/2001 | Spencer | B05B 11/0051 222/256 |
| 6,695,179 | B2 | 2/2004 | Mandile | |
| D561,304 | S | 2/2008 | Vansell et al. | |
| 7,464,834 | B2 | 12/2008 | Law et al. | |
| 7,490,743 | B2 | 2/2009 | Herzog | |
| 8,545,462 | B2 | 10/2013 | Ghannoum | |
| 2004/0060888 | A1 * | 4/2004 | Ahn | A61J 9/00 215/11.1 |
| 2006/0163292 | A1 | 7/2006 | Wauters et al. | |
| 2013/0116597 | A1 | 5/2013 | Rudge | |
| 2015/0119863 | A1 | 4/2015 | Christensen | |
| 2016/0175530 | A1 | 6/2016 | Mide | |

OTHER PUBLICATIONS

Sally O.; Mommy's Reviews: "Contigo Autospout Gizmo Flip Water Bottle Review & Giveaway"; retrieved from www.mommysreviews.com/2015/08/contigo-autospout-gizmo-flip-water.html, publicly available at least as of Nov. 11, 2016; website visited Dec. 31, 2016.

U.S. Appl. No. 14/940,580, filed Nov. 13, 2015, Conduit Terminus and Related Fluid Transport System and Method, Michael A. Zumbrum.

U.S. Appl. No. 29/545,520, filed Nov. 13, 2015, Fluid Conduit Transfer Tip, Michael A. Zumbrum.

* cited by examiner

CONDUIT TERMINUS AND RELATED FLUID TRANSPORT SYSTEM AND METHOD

TECHNICAL FIELD

This disclosure relates generally to a conduit terminus for use in receiving and/or dispensing substances and a related fluid transport system and method.

BACKGROUND

During certain manufacturing processes, vessels containing various fluids are used. Often it is necessary to transfer fluid into or out of a vessel during the process and do so in a manner that eliminates or substantially eliminates the possibility of leakage or contamination. In particular, the need to transfer fluid in such a manner often arises in the manufacturing and processing of pharmaceuticals, biopharmaceuticals, or other biotechnology applications where processes are conducted in vessels of varying shapes and sizes. The need for fluid transfer into and out of a vessel arises in other applications and industries as well, including but not limited to, the production of food, cosmetics, paint, chemicals, including hazardous chemicals, and the transfer and handling of semiconductor fluids.

Regardless of the industry, during transfers or sampling, it may be desirable to transfer the entire contents, or substantially the entire contents, of the vessel. However, conduits employed to transfer fluids into and out of vessels may not be configured to reach the lowest point in the vessel. Thereby, some fluid may typically remain in the vessel during an attempted transfer of the contents thereof, which may increase operational expenses and/or skew analyses regarding the removed fluid.

Thus, what is needed is a conduit terminus configured to access and receive substantially all of the fluid in a vessel during a fluid transfer operation without requiring significant user input.

SUMMARY

Briefly described, in one aspect there is disclosed a conduit terminus. The conduit terminus may include a body including a head portion and an engagement portion. The body may include an aperture extending along a longitudinal axis through the head portion and the engagement portion and between a first opening at the head portion and a second opening at the engagement portion. The head portion may taper to a tip defining the first opening. The first opening may have a contour that is non-planar.

In some embodiments the tip may form a recess at the first opening that is concave. Further, the tip may form a protrusion at the first opening that is convex. The first opening may be substantially circular and may have a radius. The contour of the first opening may have a radius of curvature with respect to an axis extending substantially perpendicular to the longitudinal axis. The radius of the first opening may be less than the radius of curvature of the contour of the first opening at the tip. The second opening may be substantially circular and the radius of the first opening may be less than a radius of the second opening.

In some embodiments the head portion may include a plurality of ribs. The head portion may further include a stop configured to engage an end of the conduit. The ribs may extend from the stop to the tip. The body may include a thermoplastic.

In an additional aspect a fluid transport system including the conduit terminus of Claim 1 is provided. The fluid transport system may further include the conduit and a vessel.

In some embodiments the fluid transport system may further include a container. The conduit terminus, the conduit, and the vessel may be sealed in the container. The conduit terminus, the conduit, and the vessel may define an aseptic system within the container.

In a further aspect a method of fluid removal is provided. The method may include providing a conduit, a vessel, and a conduit terminus. The conduit terminus may include a body including a head portion and an engagement portion engaged with the conduit. The body may include an aperture extending along a longitudinal axis through the head portion and the engagement portion between a first opening at the head portion and a second opening at the engagement portion. The head portion may taper to a tip defining the first opening. The first opening may have a contour that is non-planar. The method may additionally include at least partially filling the vessel with a fluid. Further, the method may include withdrawing at least some of the fluid from the vessel through the conduit terminus and the conduit.

In some embodiments the method may further include inserting the conduit terminus and at least a portion of the conduit into the vessel. Inserting the conduit terminus and at least the portion of the conduit into the vessel may include engaging the tip of the conduit terminus with a wall of the vessel. Engaging the tip of the conduit terminus with the wall of the vessel may include engaging a bottom wall of the vessel.

In some embodiments the method may further include providing a vessel closure defining a conduit aperture. The method may additionally include inserting the conduit through the conduit aperture. Further, the method may include engaging the vessel closure with the vessel. Additionally, the method may include engaging the engagement portion of the conduit terminus with the conduit.

Thus, conduit termini and related fluid transport systems and methods are disclosed that possess distinct attributes and represent distinct improvements over the prior art. These and other aspects, features, and advantages of the conduit termini and related fluid transport systems and methods of this disclosure will be better understood and appreciated upon review of the detailed description set forth below when taken in conjunction with the accompanying drawing figures, described briefly below. According to common practice, the various features of the drawings may not be drawn to scale. Dimensions and relative sizes of various features and elements in the drawings may be shown enlarged or reduced to illustrate more clearly the embodiments of the present disclosure.

DETAILED DESCRIPTION OF EMBODIMENTS

Certain exemplary embodiments of the present disclosure are described below and illustrated in the accompanying figures. The embodiments described are only for purposes of illustrating the present disclosure and should not be interpreted as limiting the scope of the disclosure, which, of course, is limited only by the claims below. Other embodiments of the disclosure, and certain modifications and improvements of the described embodiments, will occur to those skilled in the art, and all such alternate embodiments, modifications, and improvements are within the scope of the present disclosure.

Figure 1:
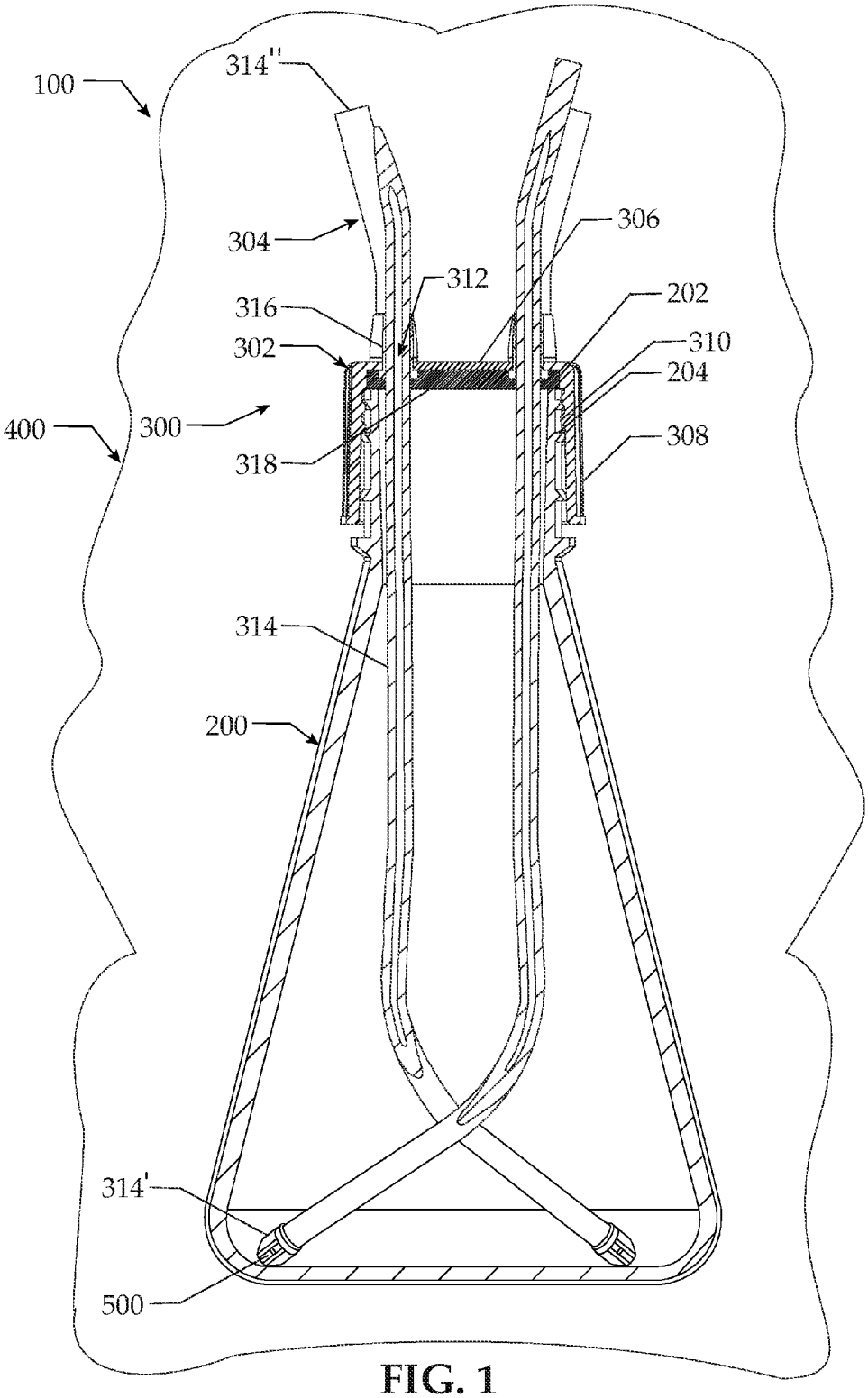
FIG. 1 illustrates a sectional view through a fluid transport system including a vessel closure assembly, a vessel, and a conduit terminus according to an example embodiment of the present disclosure.

Referring now in more detail to the drawing figures, wherein like reference numerals indicate like parts throughout the several views, FIG. 1 illustrates a sectional view through an embodiment of a fluid transport system 100 according to an example embodiment of the present disclosure. The fluid transport system 100 may include a vessel 200 and a vessel closure assembly 300. The fluid transport system 100 may additionally be contained in an outer container 400 (e.g., a plastic bag), and the vessel 200 and the vessel closure assembly 300 may be sealed in the outer container 400. In some embodiments the vessel 200, the vessel closure assembly 300, and the components thereof may define an aseptic system within the outer container 400.

In this regard, the fluid transport system 100 disclosed herein may be assembled and then the entire devices or components thereof may be rendered substantially aseptic by, for example, gamma radiation. Alternatively, the entire devices or components thereof may be rendered substantially aseptic by exposure to steam above 121° C. for a period of time long enough to eliminate microorganisms. The entire devices or components thereof may also be rendered aseptic by chemical treatment, such as with ethylene oxide (ETC)). Once rendered substantially aseptic, the vessel 200, and the vessel closure assembly 300 may be appropriately packaged within the outer container 400, which may also be rendered substantially aseptic as described above, to maintain the substantially aseptic state until ready for use.

The fluid transport system 100 may include various embodiments of the vessel 200. In the illustrated embodiment the vessel 200 comprises an Erlenmeyer flask. However, the vessel 200 may additionally comprise, without limitation, bags (e.g., bioreactor bags), bottles, syringes, containers, beakers, receptacles, tanks, vats, vials, tubes (e.g., centrifuge tubes), and the like that are generally used to contain fluids, slurries, and other similar substances.

Similarly, the particular configuration of the vessel closure assembly 300 may vary. Regardless of the particular configuration thereof, the vessel closure assembly 300 may be configured to sealingly engage an opening 202 to the vessel 200, which may be defined at a top thereof. In an example embodiment, the vessel closure assembly 300 may include a vessel closure 302 and one or more constructs 304.

In the illustrated embodiment of the vessel closure assembly 300, the vessel closure 302 is a cap. Suitable caps for the vessel closure 302 include those commonly used in the field of pharmaceutical, biopharmaceutical, and biotechnology processing. Such caps include: a 1 L Erlenmeyer flask cap with an inner diameter at the opening end of approximately 43 mm and being approximately 30 mm in height, a 3 L Erlenmeyer flask cap with an inner diameter at the opening end of approximately 70 mm and being approximately 30 mm in height, a 38-430 cap with an outer diameter at the open end of approximately 42 mm and being approximately 29 mm tall, a centrifuge cap having an outer diameter at the open end of approximately 34 mm and being approximately 13 mm tall, a 20-415 cap with an outer diameter at the open end of approximately 24 mm and being approximately 14.6 mm tall; a GL-45 cap having an outer diameter at the open end of approximately 53.7 mm and being approximately 25.5 mm tall, a GL-45 cap having an outer diameter at the open end of approximately 53.7 mm and being approximately 25.5 mm tall, a GL-32 cap having an inner diameter at the opening end of approximately 32 mm and being approximately 26 mm tall, a GL-25 cap having an inside diameter at the open end of approximately 25 mm and being approximately 20 mm in height, bung ports, 53B carboy caps, and 83B carboy caps. The vessel closure 102, however, is not limited to a cap of any particular dimensions.

The vessel closure 302 may be made from thermoplastics such as polyolefins, polypropylene, polyethylene, polysulfone, polyester, polycarbonate, and glass filled thermoplastics. The vessel closure 302, however, is not limited to any particular material(s). The vessel closure 302 may also be made from thermosets such as epoxies, pheonolics, and novolacs. The vessel closure 302 may also be a hygienic or sanitary clamp having dimensions disclosed in ASME BPE table DT-5-2 ("Hygienic Clamp Ferrule Standard Dimensions and Tolerances") (2009), which is incorporated by reference herein in its entirety. The vessel closure is not limited to caps or hygienic clamps but may constitute any suitable closure that seals the interior of a vessel from the exterior environment.

In one embodiment the vessel closure 302 may include a top wall 306 and a sidewall 308 connected thereto and extending downwardly therefrom at substantially a right angle. The sidewall 308 may be substantially cylindrical and include an outer surface which may be fluted and include a plurality of groves and ridges to provide improved grip that facilitates twisting the vessel closure 302 during engagement and disengagement with the vessel 200.

In this regard, the vessel 200 may include a plurality of threads 204. The threads 204 may be defined at an outer surface of the vessel 200 proximate the opening 202. Further, the vessel closure 302 may include a plurality of corresponding threads 310, which may be defined at an inner surface of the sidewall 308. Thereby, the corresponding threads 310 of the vessel closure 302 may engage the threads 204 of the vessel 200 to bring the vessel closure assembly 300 into engagement with the vessel and seal the opening 202.

Note that although a threaded connection is described above as being employed to engage the vessel closure assembly 300 with the vessel 200, various other connection mechanisms may be employed in other embodiments. By way of example, in other embodiments the connection mechanism may comprise a clamp connection, a welded connection, a bonded connection, or any other mechanical means. Alternatively, the vessel closure may be formed as a singular unit with the vessel. For example, the vessel may be formed in a manner whereby the vessel closure is formed as an integral component of the vessel when the vessel is manufactured. Regardless of whether the vessel closure is a separate component, or formed as an integral part of the vessel, the vessel closure and the vessel form a leak-free connection.

With further regard to the vessel closure assembly 300, one or more conduit apertures 312 (see, e.g., FIG. 1) may extend through the vessel closure 320. In particular, the apertures 312 may extend through the top wall 306 of the vessel closure 302. The apertures 312 may be made using a punch press, a drill, mill, laser, or any combination thereof. In another embodiment, the apertures 312 are molded when the vessel closure is molded.

The one or more constructs 304 may be engaged with and extend through the one or more apertures 312 defined through the vessel closure 302. Various embodiments of the constructs 304 may be employed. In some embodiments one or more of the constructs 304 may comprise a conduit 314.

It should be understood that the vessel closure assembly 300 is not limited to use with any particular fluids. However, depending on the size and composition of the vessel closure assembly 300 and its constituent conduits 314, the vessel closure assembly 300 may be used with fluids with particulates or having a high viscosity or with fluids having no or very little particulate content or low viscosity.

The one or more constructs 304 may further comprise anchors 316. The anchors 316 may be configured to secure the conduits 314 to the vessel closure 302. During assembly, the conduit 314 may be inserted through the anchor 316, or the anchor may be integrally formed with the conduit. Thereby, the conduit 314 may extend or pass through the anchor 316. Further, the conduit 314 and the anchor 316 may be inserted through one of the apertures 312 defined through the vessel closure 302. Thereby, the anchor 316 may be friction or interference fit into the aperture 312 in the vessel closure 302.

Thus, the anchor 316 may seal against both the vessel closure 302 and the conduit 314 so as to prevent fluid leakage at the apertures 312. However, in some embodiments the vessel closure assembly 300 may further comprise a cast seal 318. The cast seal 318 may surround, secure, and seal the conduits 314 and/or the anchors 316 to the vessel closure 302. Utilizing a cast seal 318 allows for integration of the conduits 314 from within the vessel closure 302 or within the vessel 200 to a point exterior of the vessel, thereby providing a continuous fluid pathway without the use of connectors such as barbed or luer connectors.

In one embodiment the cast seal 318 is constructed from a self-leveling, pourable silicone such as room-temperature-vulcanizing ("RTV") silicone. The RTV silicone may be a two-component system (base plus curative) ranging in hardness from relatively soft to a medium hardness, such as from approximately 9 Shore A to approximately 56 Shore A. Suitable RTV silicones include Wacker® Elastocil® RT 622, a pourable, addition-cured two-component silicone rubber that vulcanizes at room temperature (available from Wacker Chemie AG), and Rhodorsil® RTV 1556, a two-component, high strength, addition-cured, room temperature or heat vulcanized silicone rubber compound (available from Blue Star Silicones). Both the Wacker® Elastocil® RT 622 and the Bluestar Silicones Rhodorsil® RTV 1556 have a viscosity of approximately 12,000 cP (mPa·s). The aforementioned silicones and their equivalents offer low viscosity, high tear cut resistance, high temperature and chemical resistance, excellent flexibility, low shrinkage, and the ability to cure into the cast seal 318 at temperatures as low as approximately 24° C. (75° F.). The cast seal 318 may also be constructed from dimethyl silicone or low temperature diphenyl silicone or methyl phenyl silicone. An example of phenyl silicone is Nusil MED 6010. Phenyl silicones are particularly appropriate for cryogenic applications. In another embodiment, the casting agent is a perfluoropolyether liquid. An example perfluoropolyether liquid is Sifel 2167, available from Shin-Etsu Chemical Co., Ltd. of Tokyo, Japan.

In an embodiment, the cast seal 318 is disposed within the interior of the vessel closure 302 defined by the top wall 306 and the side wall 308 so that when the vessel closure is connected to or integrally combined into the vessel 200, the cast seal creates an aseptic seal between the interior of the vessel and the exterior of the vessel, due to contact with the vessel proximate the opening 202, thereby protecting an environment within the vessel and maintaining a closed and hygienic system. The seal formed by the conduits 314 between the interior of the vessel 200 and the exterior environment may be substantially aseptic. The cast seal 318 surrounds the fluid transfer conduits 314 and the anchors 316, thereby creating a seal. In an embodiment, the seal between the cast seal 318 and the constructs 304 is substantially aseptic.

In one embodiment, the constructs 304 may include conduits 314 comprising silicone tubing. The silicone tubing may be of any length suitable and necessary for the desired process. In an embodiment, at least a portion of the silicone tubing is treated with a primer where the cast seal 318 (e.g., cast silicone) surrounds the silicone tubing. Suitable primers are SS-4155 available from Momentive™ Med-162 available from NuSil Technology, and Rodorsil® V-O6C available from Bluestar Silicones of Lyon, France.

In another embodiment, the cast seal 318 is connected to the vessel closure 302 by way of priming at least a portion of the vessel closure and adhesively attaching the cast seal to the vessel closure. In this embodiment, the cast seal 318 will not pull away from the interior of the vessel closure 302.

The conduit 314 may comprise thermoplastic tubing, thermoset tubing, elastomeric tubing, or any combination thereof. If a thermoset is used, silicones, polyurethanes, fluoroelastomers or perfluoropolyethers are example construction materials for the conduits. If a thermoplastic is used, C-Flex® tubing, block copolymers of styrene-ethylene-butylene-styrene, PureWeld, PVC, polyolefins, or polyethylene are example construction materials. Multiple conduits may be used including combinations of elastomeric, thermoset, and thermoplastic materials in the same vessel closure assembly.

When the constructs 304 include anchors 316, the cast seal 318 need not be constructed of cast silicone but may be made of any casting agent capable of bonding to the anchors or other construct. For example, in applications involving solvents, a casting agent such as perfluoropolyether liquid potting material could be used. Primers can be used to enhance bonding to the construct and/or body.

Each of the conduits 314 may extend between a first terminus 314' and a second terminus 314", examples of which are shown in FIG. 1. The first terminus 314' may be configured to be positioned in direct fluid communication with the vessel 200. In this regard, the first terminus 314' may be positioned at or within an interior of the vessel closure 302 and/or at or within an interior of the vessel 200 when the vessel closure assembly 300 is coupled thereto.

Conversely, as illustrated in FIG. 1, all or a portion of the conduits 314 may extend through the apertures 312 and terminate at a first terminus 314' configured to extend inside the vessel 200 to which the vessel closure assembly 300 is coupled. The conduits 314 that include a first terminus 314' positioned within the vessel 200 to which the vessel closure 302 is attached may be configured, for example, to draw liquid from the vessel or direct liquid into the vessel proximate to the bottom thereof with a minimum of turbulence.

Whereas the first terminus 314' may be positioned within the vessel closure 300 or within the vessel 200, the conduits 314 may terminate at a second terminus 314" outside the vessel. Further, the second terminus 314" of the conduits 314 may terminate at least partially outside the vessel closure 302. The second terminus 314" may in some embodiments include a fitting. Examples of fittings that may be included at the second terminus 314" may be selected from the group consisting of an aseptic connector, an air-tight fitting, a plug, and a needleless access site.

Additionally, in some embodiments the constructs 304 may include a conduit terminus 500. In some embodiments the conduit terminus may be engaged with the first terminus 314' of the conduit 314. In this regard, the conduit terminus 500 may be not only configured to dispense a substance, such as a fluid, but also to receive a substance therethrough. For example, the conduit terminus 500 may be particularly configured to improve the ability of the vessel closure assembly 300 to extract a substance from the vessel 200.

Figure 2:
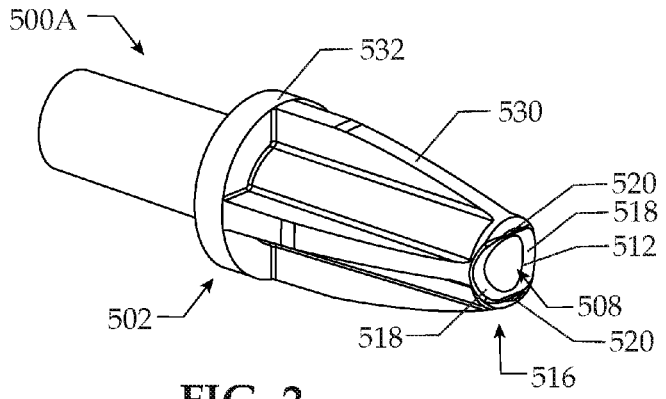
FIG. 2 illustrates a perspective view of a first embodiment of the conduit terminus according to an example embodiment of the present disclosure.
Figure 3:
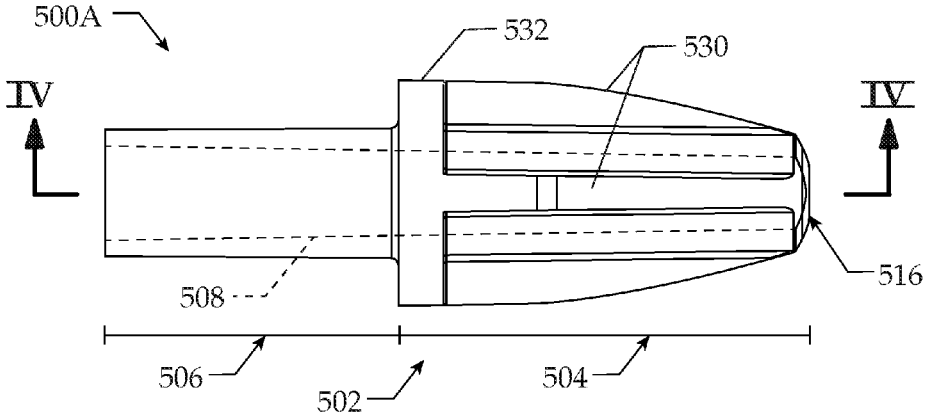
FIG. 3 illustrates a side view of the conduit terminus of FIG. 2.
Figure 4:
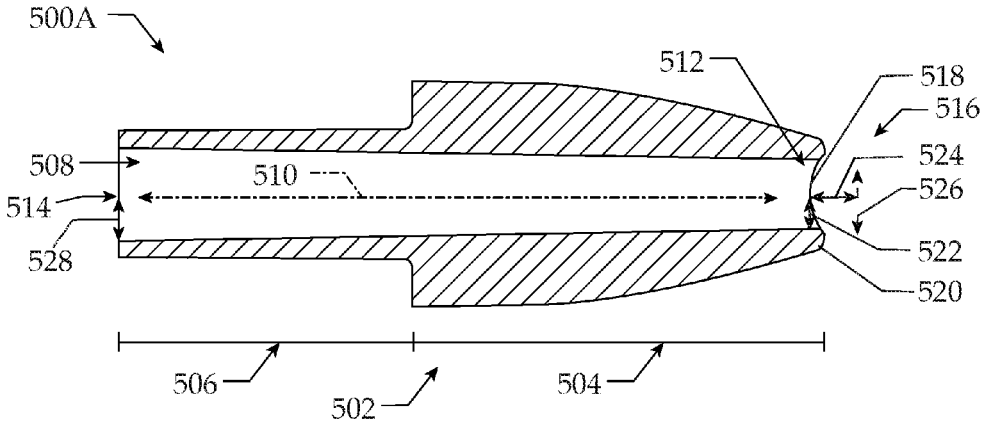
FIG. 4 illustrates a sectional view of the conduit terminus of FIG. 3 along line IV-IV.

In this regard, FIGS. 2-4 illustrate a first embodiment of the conduit terminus 500A. In particular, FIG. 2 illustrates a perspective view of the conduit terminus 500A, FIG. 3 illustrates a side view of the fluid conduit terminus, and FIG. 4 illustrates a sectional view through the fluid conduit terminus along line IV-IV from FIG. 3.

As illustrated, the conduit terminus 500A may include a body 502. In some embodiments the body 502 may comprise polyethylene. Polyethylene may define a relatively low coefficient of friction with respect to the materials typically employed to form the vessel 200 (see, FIG. 1). Thereby, the conduit terminus 500A may easily slide to a desired position in the vessel 200 (see, FIG. 1) such as a lower corner thereof. In contrast, the conduit 314 (see, FIG. 1) may be formed from a material that tends to stick and bind against the vessel 200 (see, FIG. 1), thereby making it more difficult to move a conduit that does not include the conduit terminus 500A to a desired position. In one example, conduit terminus 500A is constructed from a thermoplastic. In another example, conduit terminus 500A is constructed from a polyolefin. More specifically, conduit terminus may be constructed from various materials, including without limitation, polyester, polyether sulfone, polyvinylidine fluoride, polycarbonate, polytetrafluoroethylene, polyethylene, polypropylene, polyamide, polyimide, polyetheretherketone, composites of multiple polymers, and glass-filled thermoplastics.

As illustrated in FIG. 3, the body 502 may include a head portion 504 and an engagement portion 506. The head portion 504 may be configured to dispense and/or receive a substance (e.g., a fluid) therethrough. The engagement portion 506 may be configured to engage a conduit such as the above-described conduit 314 (see, FIG. 1).

As illustrated in FIG. 4, the body 502 may comprise an aperture 508 extending along a longitudinal axis 510 through the head portion 504 and the engagement portion 506 between a first opening 512 at the head portion and a second opening 514 at the engagement portion. As further illustrated in FIG. 4, the head portion 504 may taper to a tip 516 defining the first opening 512.

By tapering the head portion 504 to the tip 516, the conduit terminus 500A may be configured to reach into confined areas such as a lower corner of the vessel 200 (see, FIG. 1), in order to allow all or substantially all of the substance in the vessel to be removed therefrom through the conduit 314 (see, FIG. 1).

The tip 516 may be configured such that the first opening 512 may have a contour that is non-planar. The non-planar configuration of the first opening 512 may facilitate removal of fluid and/or other substances from the vessel 200 (see, FIG. 1) by substantially avoiding blockage of the first opening by surrounding structures. For example, in the event the tip 516 contacts an inner surface of the vessel 200 (see, FIG. 1), the contour of the first opening 512 may resist the inner surface of the vessel from completely blocking the first opening.

Thus, usage of the non-planar first opening 512 may facilitate drawing substances from the vessel 200 (see, FIG. 1) when suction is applied to the conduit 314 (see, FIG. 1) to which the conduit terminus 500A is attached. Various embodiments of non-planar configurations of the first opening 512 may be employed. For example, as further illustrated in FIG. 4, the tip 516 may form a recess 518 at the first opening 512 that is concave. Further, the tip 516 may form a protrusion 520 at the first opening 512 that is convex. More particularly, as illustrated in FIG. 2, the first opening 512 may include a pair of opposing concave recesses 518 and a pair of opposing convex protrusions 520. Thus, as described above, the pairs of opposing convex protrusions 520 and concave recesses 518 may provide the first opening 512 with a non-planar configuration that resists blockage by the inner surfaces of the vessel 200 (see, FIG. 1).

In some embodiments the first opening 512 may be substantially circular and have a radius 522 (see, FIG. 4). Further, the contour of the first opening 512 may have a radius of curvature 524 with respect to an axis 526 extending substantially perpendicular to the longitudinal axis 510 of the aperture 508. The radius of the aperture 508 at the first opening 512 may be less than the radius of curvature 524 of the contour of the first opening at the tip 516. In this regard, the contour of the first opening 512 may not be so extreme as to provide a relatively large longitudinal distance between the recesses 518 and the protrusions 520. Thereby, issues with respect to a significant reduction in suction occurring at the first opening 512 may be substantially avoided as a result of the non-planar shaped of the first opening.

Further, the second opening 514 may be substantially circular and have a radius 528 (see, FIG. 4). The radius 522 of the first opening 512 may be less than the radius 528 of the second opening 514. In this regard, the tip 516 may be relatively small such that the conduit terminus 500A may fit into corners in the vessel 200 (see, FIG. 1). Conversely, the aperture 508 may gradually transition to the relatively larger second opening 514 that defines a radius 528 more closely matching that of the conduit 314 (see, FIG. 1). Thereby, less turbulence may occur at the interface between the conduit terminus 500A and the conduit 314 such that damage to the substance being directed therethrough may be lessened.

In some embodiments, as illustrated in FIG. 3, the head portion 504 may include a plurality of ribs 530. The ribs 530 may be employed by a user when engaging the engagement portion 506 of the body 502 with the conduit 314 (see, FIG. 1). In this regard, the ribs 530 may be employed to twist the conduit terminus 500A during engagement with the conduit 314 (see, FIG. 1).

The ribs 530 may extend from the tip 516 to a stop 532, which is defined at the head portion 504. The stop 532 may be configured to engage an end of the conduit 314 (see, FIG. 1). The stop 532 may additionally provide a structure that may be pressed during engagement of the conduit terminus 500A with the conduit 314 (see, FIG. 1), so as to further facilitate engagement therebetween.

Note that although the conduit terminus is described herein as comprising a separate component that is engaged with a conduit, in other embodiments the conduit terminus may be integral with the conduit. In this embodiment the engagement portion may not be included or may be provided as an integral structure with the conduit. Further, the head portion may be provided at the end of the conduit, so as to function in the manner described herein.

Figure 5:
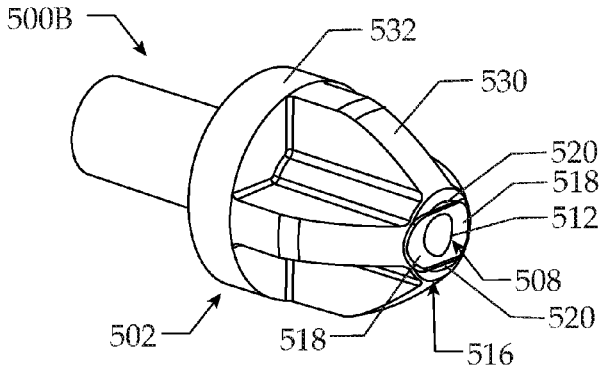
FIG. 5 illustrates a perspective view of a second embodiment of the conduit terminus according to an example embodiment of the present disclosure.
Figure 6:
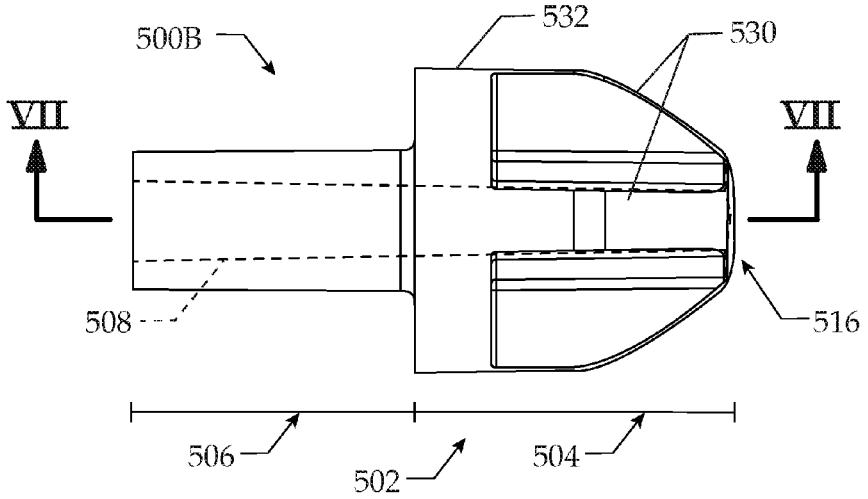
FIG. 6 illustrates a side view of the conduit terminus of FIG. 5.
Figure 7:
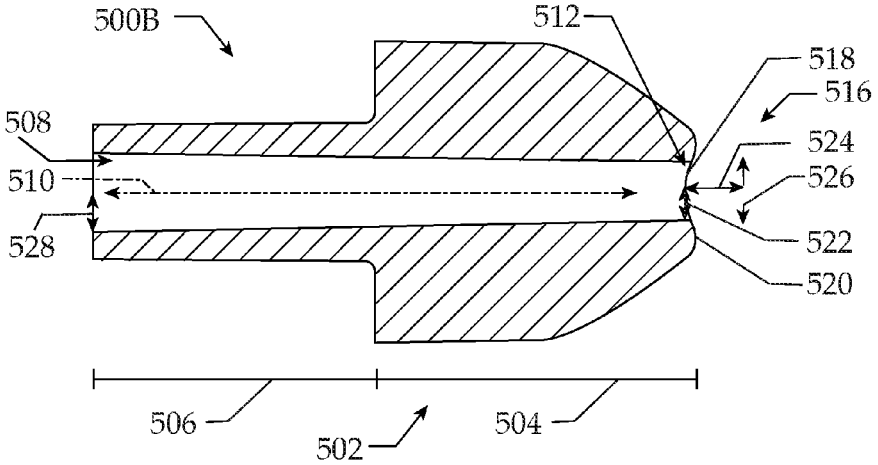
FIG. 7 illustrates a sectional view of the conduit terminus of FIG. 6 along line VII-VII.
Figure 8:
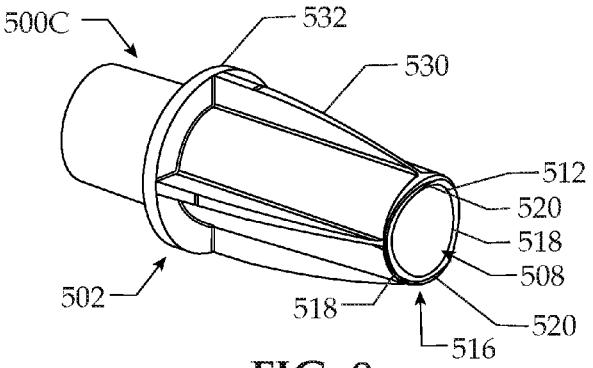
FIG. 8 illustrates a perspective view of a third embodiment of the conduit terminus according to an example embodiment of the present disclosure.
Figure 9:
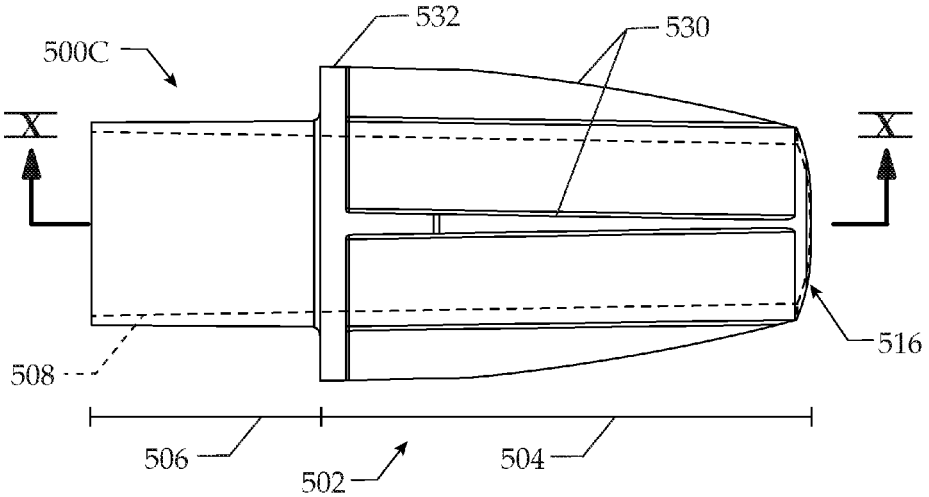
FIG. 9 illustrates a side view of the conduit terminus of FIG. 8.
Figure 10:
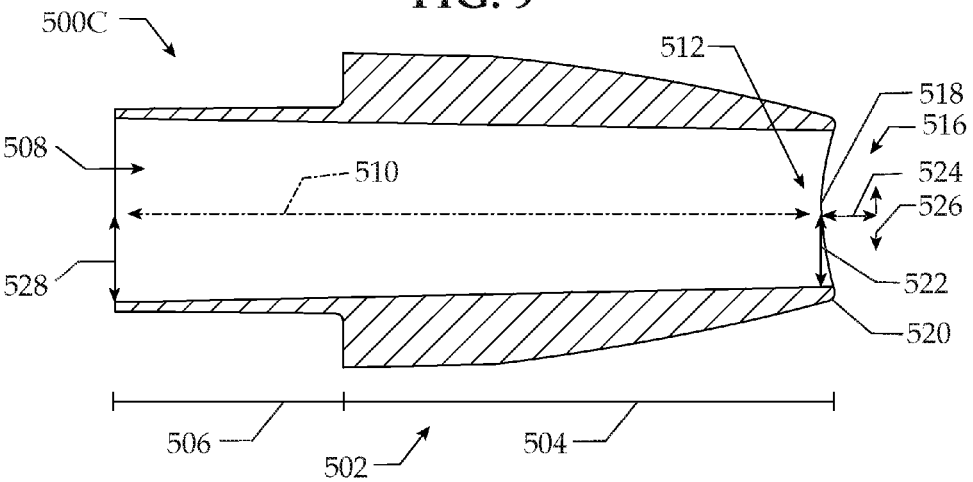
FIG. 10 illustrates a sectional view of the conduit terminus of FIG. 9 along line X-X.
Figure 11:
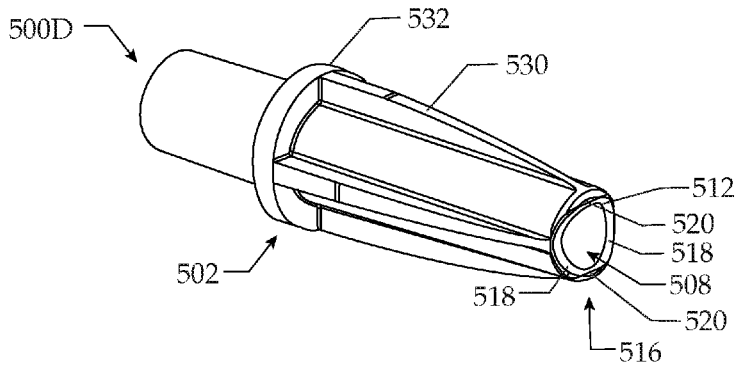
FIG. 11 illustrates a perspective view of a fourth embodiment of the conduit terminus according to an example embodiment of the present disclosure.
Figure 12:
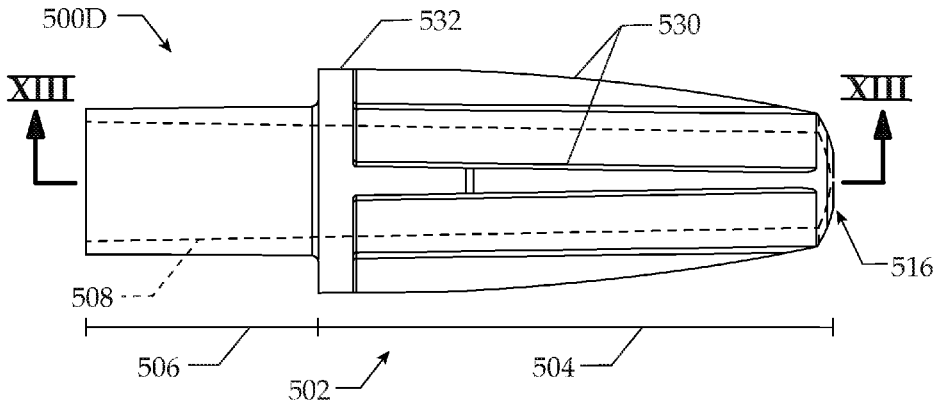
FIG. 12 illustrates a side view of the conduit terminus of FIG. 11.
Figure 13:
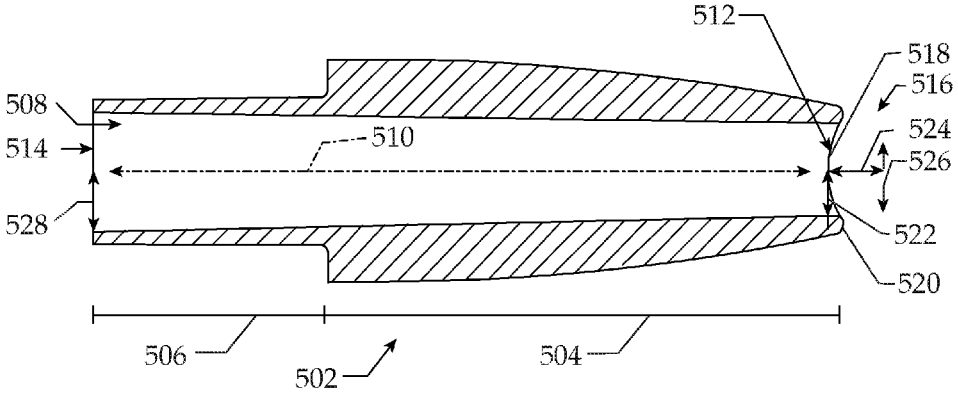
FIG. 13 illustrates a sectional view of the conduit terminus of FIG. 12 along line XIII-XIII.
Figure 14:
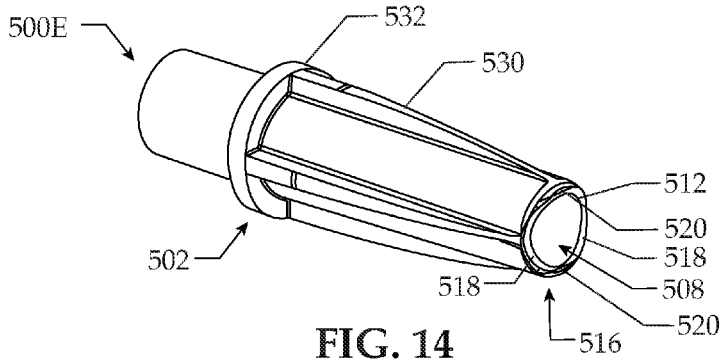
FIG. 14 illustrates a perspective view of a fifth embodiment of the conduit terminus according to an example embodiment of the present disclosure.
Figure 15:
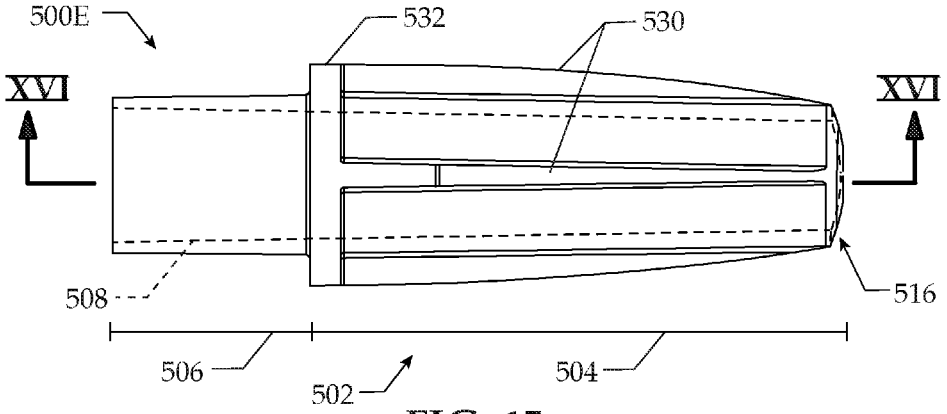
FIG. 15 illustrates a side view of the conduit terminus of FIG. 14.
Figure 16:
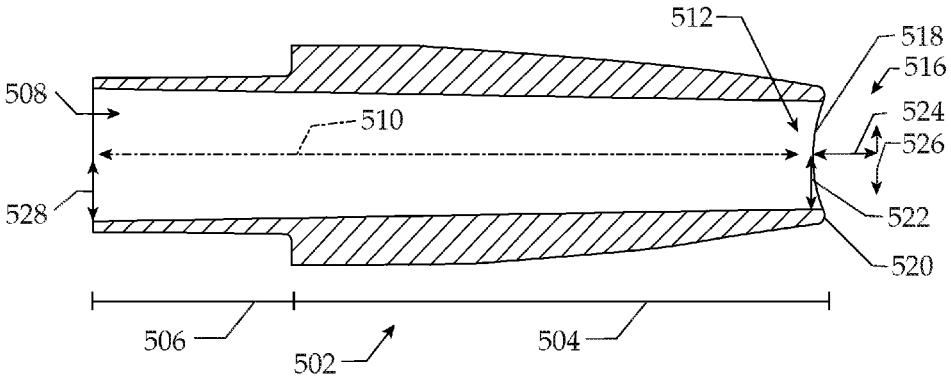
FIG. 16 illustrates a sectional view of the conduit terminus of FIG. 14 along line XVI-XVI.

Additionally, although a particular shape of the conduit terminus 500A is illustrated in FIGS. 2-4, it should be understood that this shape may differ without varying from the scope of the present disclosure. In this regard, FIGS. 5-7 illustrate a second embodiment of the conduit terminus 500B, FIGS. 8-10 illustrate a third embodiment of the conduit terminus 500C, FIGS. 11-13 illustrate a fourth embodiment of the conduit terminus 500D, and FIGS. 14-16 illustrate a fifth embodiment of the conduit terminus 500E. The conduit terminus 500B of FIGS. 5-7 includes a head portion 504 that is generally more truncated. The conduit terminus 500C of FIGS. 8-10 includes a relatively larger first opening 512. The conduit terminus 500D of FIGS. 11-13 includes a head portion 504 that is relatively more elongated. The conduit terminus 500E of FIGS. 14-16 includes a head portion 504 that is relatively more elongated and includes a relatively larger first opening 512. Further, although features of the conduit terminus are illustrated as having particular configurations in the drawings, it should be understood that the conduit may have other configurations in other embodiments.

In an additional embodiment a method of fluid removal is provided. The method may include providing a conduit (e.g. the conduit 314; see FIG. 1), a vessel (e.g., the vessel 200; see, FIG. 1), and a conduit terminus (e.g., the conduit terminus 500; see, FIG. 1). The conduit terminus may include a body comprising a head portion and an engagement portion engaged with the conduit. The body may comprise an aperture extending along a longitudinal axis through the head portion and the engagement portion between a first opening at the head portion and a second opening at the engagement portion. The head portion may taper to a tip defining the first opening, the first opening having a contour that is non-planar. Further, the method may include at least partially filling the vessel with a fluid. The method may additionally include withdrawing at least some of the fluid from the vessel through the conduit terminus and the conduit.

In some embodiments the method may further comprise inserting the conduit terminus and at least a portion of the conduit into the vessel. Inserting the conduit terminus and at least the portion of the conduit into the vessel may include engaging the tip of the conduit terminus with a wall of the vessel. Engaging the tip of the conduit terminus with the wall of the vessel may include engaging a bottom wall of the vessel.

Further, the method may include providing a vessel closure defining a conduit aperture. The method may additionally include inserting the conduit through the conduit aperture. The method may also include engaging the vessel closure with the vessel. The method may further include engaging the engagement portion of the conduit terminus with the conduit.

The foregoing descriptions of fluid transport systems, conduit termini, and methods of fluid removal illustrate and describe various embodiments. As various changes can be made in the above embodiments without departing from the scope of the present disclosure recited and claimed herein, it is intended that all matter contained in the above description or shown in the accompanying figures shall be interpreted as illustrative and not limiting. Furthermore, the scope of the present disclosure covers various modifications, combinations, alterations, etc., of the above-described embodiments that all are within the scope of the claims. Additionally, the disclosure shows and describes only selected embodiments of the present disclosure, but the present disclosure is capable of use in various other combinations, modifications, and environments and is capable of changes or modifications within the scope of the disclosure as expressed herein, commensurate with the above teachings, and/or within the skill or knowledge of artisans in the relevant art. Furthermore, certain features and characteristics of each embodiment may be selectively interchanged and applied to other illustrated and non-illustrated embodiments of the present disclosure without departing from the scope of the present disclosure.

The invention claimed is:

1. A conduit terminus, comprising:

a body comprising a head portion and an engagement portion, the body comprising an aperture extending along a longitudinal axis through the head portion and the engagement portion and between a first opening at the head portion and a second opening at the engagement portion, the head portion tapering to a tip defining the first opening, the first opening having a contour that is non-planar, wherein the head portion comprises a plurality of ribs, wherein the head portion further comprises a stop configured to engage an end of the conduit, wherein the ribs extend from the stop to the tip.

2. The conduit terminus of claim 1, wherein the tip forms a recess at the first opening that is concave.

3. The conduit terminus of claim 1, wherein the tip forms a protrusion at the first opening that is convex.

4. The conduit terminus of claim 1, wherein the first opening is substantially circular and having a radius, the contour of the first opening having a radius of curvature with respect to an axis extending substantially perpendicular to the longitudinal axis, and wherein the radius of the first opening is less than the radius of curvature of the contour of the first opening at the tip.

5. The conduit terminus of claim 4, wherein the second opening is substantially circular and the radius of the first opening is less than a radius of the second opening.

6. The conduit terminus of claim 1, wherein the body comprises a thermoplastic.

7. A fluid transport system comprising the conduit terminus of claim 1 and further comprising:

the conduit; and a vessel.

8. The fluid transport system of claim 7, further comprising a container, wherein the conduit terminus, the conduit, and the vessel are sealed in the container.

9. The fluid transport system of claim 8, wherein the conduit terminus, the conduit, and the vessel define an aseptic system within the container.

10. A conduit terminus, comprising:

a body comprising a head portion and an engagement portion, the body comprising an aperture extending along a longitudinal axis through the head portion and the engagement portion and between a first opening at the head portion and a second opening at the engagement portion, the head portion tapering to a tip defining the first opening, the first opening having a contour that is non-planar, wherein the first opening is substantially circular and having a radius, the contour of the first opening having a radius of curvature with respect to an axis extending substantially perpendicular to the longitudinal axis, wherein the radius of the first opening is less than the radius of curvature of the contour of the first opening at the tip, and wherein the second opening is substantially circular and the radius of the first opening is less than a radius of the second opening.

11. The conduit terminus of claim 10, wherein the head portion comprises a plurality of ribs, wherein the head portion further comprises a stop configured to engage an end of the conduit, wherein the ribs extend from the stop to the tip.

* * * * *